US007992909B2

(12) United States Patent
Bouligny, Jr. et al.

(10) Patent No.: US 7,992,909 B2
(45) Date of Patent: Aug. 9, 2011

(54) SINGLE JOINT ELEVATOR WITH JAWS SECURED BY A POWERED DOOR

(75) Inventors: Vernon Joseph Bouligny, Jr., New Iberia, LA (US); Scott Joseph Arceneaux, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 1061 days.

(21) Appl. No.: 11/776,657

(22) Filed: Jul. 12, 2007

(65) Prior Publication Data

US 2009/0014169 A1 Jan. 15, 2009

(51) Int. Cl.
*E21B 19/06* (2006.01)

(52) U.S. Cl. ..... 294/102.2; 294/88; 294/102.1

(58) Field of Classification Search ..... 294/102.2, 294/88, 90, 91, 102.1; 188/67; 166/77.52
See application file for complete search history.

(56) References Cited

U.S. PATENT DOCUMENTS

| | | | | | |
|---|---|---|---|---|---|
| 1,211,999 | A | | 1/1917 | Arey et al. | |
| 1,535,625 | A | | 4/1925 | O'Bannon | |
| 1,548,337 | A | | 8/1925 | Smith | |
| 1,656,582 | A | | 1/1928 | Harder | |
| 1,754,288 | A | | 4/1930 | Smith | |
| 1,766,920 | A | | 6/1930 | Moody | |
| 2,009,942 | A | | 7/1935 | Moody | |
| 2,695,189 | A | * | 11/1954 | Chrisman et al. | 294/90 |
| 4,035,012 | A | | 7/1977 | Guier | |
| 4,269,554 | A | * | 5/1981 | Jackson | 414/22.63 |
| 4,275,487 | A | | 6/1981 | Gray et al. | |
| 4,361,940 | A | | 12/1982 | McFadden | |
| 4,441,749 | A | * | 4/1984 | Blaschke et al. | 294/88 |
| 4,576,254 | A | | 3/1986 | Cox | |
| 4,579,379 | A | | 4/1986 | Berg | |
| 4,647,099 | A | | 3/1987 | Berry et al. | |
| 4,676,312 | A | | 6/1987 | Mosing et al. | |
| 4,759,239 | A | * | 7/1988 | Hamilton et al. | 81/57.34 |
| 5,027,926 | A | | 7/1991 | Cox | |
| 5,127,790 | A | | 7/1992 | Teague | |
| 5,299,848 | A | | 4/1994 | Boyer | |
| 5,340,182 | A | | 8/1994 | Busink et al. | |
| 5,702,139 | A | * | 12/1997 | Buck | 294/88 |
| 5,791,410 | A | | 8/1998 | Castille et al. | |
| 5,909,768 | A | | 6/1999 | Castille et al. | |
| 6,568,479 | B2 | | 5/2003 | Mosing et al. | |

(Continued)

OTHER PUBLICATIONS

U.S. Patent and Trademark Office, "U.S. Appl. No. 11/624,771, Office Action" dated Apr. 8, 2009, pp. 1-12.

(Continued)

*Primary Examiner* — Paul T Chin
(74) *Attorney, Agent, or Firm* — Osha • Liang LLP

(57) ABSTRACT

A single joint elevator for releasably securing a tubular segment for hoisting the tubular segment into position to be threadably coupled to a pipe string suspended in a borehole. The elevator comprises two pivotally coupled jaw retainers securing jaws for engaging and gripping the tubular segment. A powered door is pivotally coupled to a first jaw retainer for selectively securing the second jaw retainer. The powered door includes a pivotable collar, a linear actuator assembly, and a linkage mechanism for selectively closing the door and clamping the distal end of the second jaw retainer to the distal end of the first jaw retainer. The actuator assembly clamps the jaw retainers with sufficient force for the jaws to grip and support the tubular segment for lifting.

13 Claims, 8 Drawing Sheets

U.S. PATENT DOCUMENTS

| | | | | |
|---|---|---|---|---|
| 7,032,678 | B2 | 4/2006 | Mosing et al. | |
| 7,762,343 | B2 * | 7/2010 | Sonneveld et al. | 166/382 |
| 2006/0185854 | A1 | 8/2006 | Mosing et al. | |
| 2008/0136203 | A1 | 6/2008 | Krijnen et al. | |

OTHER PUBLICATIONS

U.S. Patent & Trademark Office "U.S. Appl. No. 11/746,123 Office Action" dated Nov. 21, 2008, pp. 1-13.

BJ "Single Joint Elevators—Type SJ Auxiliary Elevator—Type SP Auxiliary Elevator" p. 53.

PCT "International Preliminary Report on Patentability", Jul. 31, 2009, pp. 1-8.

U.S. Appl. No. 11/746,123 "Office Action Summary", Jul. 17, 2009, 3 pages.

"SJH Horizontal Pickup Elevator" National Oilwell Varco, 2008, 1072 Rev. 03 brochure.

* cited by examiner

SINGLE JOINT ELEVATOR WITH JAWS SECURED BY A POWERED DOOR

FIELD OF THE INVENTION

The present invention is directed to an apparatus and a method for securely gripping and releasing a tubular segment for use in drilling operations, particularly for hoisting the tubular segment into alignment with a tubular string.

BACKGROUND OF THE RELATED ART

Wells are drilled into the earth's crust using a drilling rig. Tubular strings are lengthened by threadably coupling add-on tubular segments to the proximal end of the tubular string. The tubular string is generally suspended within the borehole using a rig floor-mounted spider as each new tubular segment or stand is coupled to the proximal, end of the tubular string just above the spider. A single joint elevator is used to grip and secure the segment or stand to a hoist to lift the segment or stand into position for threadably coupling to the tubular string.

For installing a string of casing, existing single joint elevators generally comprise a pair of hinged body halves that open to receive a tubular segment and close to secure the tubular within the elevator. Elevators are specifically adapted for securing and lifting tubular segments having conventional connections. A conventional connection comprises an internally threaded sleeve that receives and secures an externally threaded end from each of two tubular segments to secure the segments in a generally abutting relationship. The internally threaded sleeve is first threaded onto the end of a first tubular segment to form a "box end." The externally threaded "pin end" of the second tubular segment is threaded into the box end to complete the connection between the segments. Typical single joint elevators have a circumferential shoulder that forms a circle upon closure of the hinged body halves. The shoulder of the elevator engages the tubular segment under a shoulder formed by the end of the sleeve and the tubular segment. However, conventional single joint elevators cannot grip a tubular segment having integral connections, because an integral connection has no sleeve to form a circumferential shoulder.

What is needed is a single joint elevator that is securable to a tubular at any position along the length of the tubular segment, and not only at the sleeve. What is needed is a versatile single joint elevator that can automatically and positively open and close about a tubular segment having either integral connections or conventional connections.

SUMMARY OF THE PRESENT INVENTION

The present invention provides a single joint elevator for gripping a tubular segment to be hoisted by a hoisting member. The single joint elevator comprises a first jaw retainer having a proximal end pivotally coupled to a proximal end of a second jaw retainer for movement of the retainers between an opening position for receiving a tubular segment and a closed position for engaging the tubular segment. Each jaw retainer secures at least one jaw, and each jaw has at least one gripping surface for engaging the tubular segment. The single joint elevator also includes a powered door pivotally coupled to the distal end of the first jaw retainer for selectively securing to the distal end of the second jaw retainer. The powered door includes a pivotable collar, a linear actuator assembly supported by the pivotable collar, and a linkage mechanism for selectively closing the door. In operation, the linear actuator assembly selectively clamps the distal ends of the first and second jaw retainers with sufficient force for the jaws to grip and support the tubular segment for lilting. In order to selectively open the powered door, the linear actuator assembly should include a double-acting actuator.

In one embodiment, the linear actuator assembly includes a fluid powered motor and a drive screw rotatably coupled to the fluid powered motor, wherein the drive screw threadably engages a stationary screw collar secured to the pivotable collar. The linkage mechanism is also acted upon by the linear actuator assembly to selectively move the powered door into a closed position during a first phase of actuation. Continued movement of the linear actuator assembly selectively clamps the distal end of the second jaw retainer during a second phase of actuation. The linear actuator assembly preferably further includes a sliding plate cam that moves linearly with the linear actuator assembly to act upon the linkage mechanism. For example, the linkage mechanism may include a bell crank that is rotated by linear movement of the sliding plate cam, and wherein rotation of the bell crank pulls the powered door into the closed position.

The powered door preferably includes a clam shell clamp member that moves with the linear actuator assembly, wherein the second jaw retainer includes a clam shell seat for receiving the clam shell clamp member. Accordingly, the clam shell set self-centers the clam shell clamp member during clamping of the jaw retainers. Most preferably, the clam shell seat includes a slot for receiving a portion of the linear actuator assembly, such as a drive screw.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION OF THE PRESENT INVENTION

Figure 1:
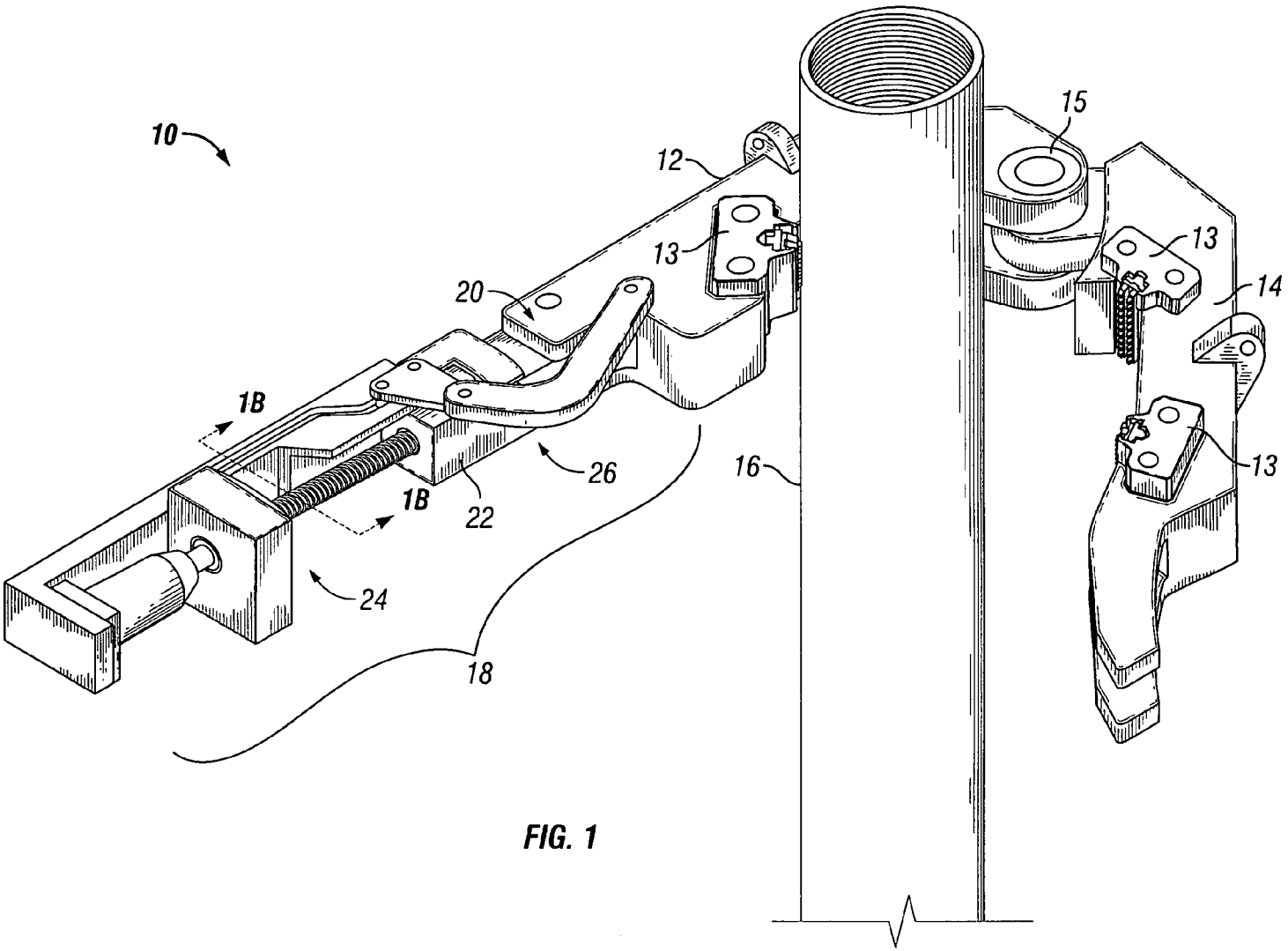
FIG. 1 is a perspective view of one embodiment of the single joint elevator of the present invention with a first jaw retainer and a second jaw retainer wide open to receive a tubular segment.

The present invention is directed to a single joint elevator for releasably securing a tubular segment to a cable, rope, line or other hoisting member. Accordingly, the tubular segment can be lifted into position to be threadably coupled to a pipe string suspended in a borehole. One embodiment of the invention comprises a first jaw retainer having a proximal end pivotally coupled to a proximal end of a second jaw retainer for movement of the retainers between an opening position for receiving a tubular segment and a closed position for engaging the tubular segment. Bach jaw retainer secures at least one jaw between its proximal end and a distal end, and each jaw has at least one gripping surface for engaging the outer wall of the tubular segment. A powered door is pivotally coupled to the distal end of the first jaw retainer for selectively securing the distal end of the second jaw retainer. The powered door includes an actuator for selectively closing the door and clamping the distal end of the second jaw retainer to the distal end of the first jaw retainer. The actuator selectively clamps the jaw retainers with sufficient force for the jaws to grip and support the tubular segment for lifting. Accordingly, the elevator can be lilted and transfer the weight of the tubular segment to a cable, rope, line or other hoisting member.

First and second jaw retainers are pivotally coupled at the proximal ends. The pivotal coupling or hinge allows the jaw retainers to open wide enough to receive a tubular segment, and then to close around the circumference of the tubular segment. The pivotal coupling or hinge may have an adjustable stop so that the opening of the jaw retainers can be customized for tubular of various diameters. Opening and closing the jaw retainers loosely about the tubular segment may be achieved manually. The jaw retainers may be spring-biased to the open position. The jaw retainers and pivotal coupling must be strong enough to support gripping forces against the tubular segment and must be precise enough that the jaw retainers pivot along a plane that is perpendicular to the axis of the pivot. Any significant misalignment or "play" in the pivot might cause misalignment of the jaws against the tubular segment or misalignment with the door.

Each jaw retainer supports at least one jaw. Preferably, the first and second jaw retainers collectively support at least three jaws, with two jaws on one jaw retainer and at least one jaw on the other jaw retainer. Even more preferably, each jaw retainer will include two jaws spaced apart and angularly oriented about ninety (90) degrees one from the other. The jaws are configured for gripping the outer surface of a tubular segment. Preferably, the jaws have a first gripping surface that faces radially inward to grip the outer surface of the tubular segment and a second surface that is tapered in order to self-tighten the grip by the first gripping surface to the tubular segment when acted upon by the weight of the tubular segment.

The powered door includes a collar pivotally coupled to the first jaw retainer, a linear actuator extendably secured to the collar, and a mechanical linkage coupled between the door and the first jaw retainer. The pivotal coupling between the collar and the first jaw retainer allows the door to move between a fully open position and a fully closed position. In the open position, the door is held open and allows a tubular segment to be received within the jaw retainers. In the closed position, the door may be selectively secured to the second jaw retainer and clamp the distal ends of the jaw retainers to prevent their separation while gripping a tubular segment. The pivotal coupling between the first jaw retainer and the collar must also be strong and precise to withstand the gripping forces and avoid misalignment of the door with the second jaw retainer.

The pivotable collar has a proximal end pivotally secured to the first jaw retainer and a second end that secures a proximal end of the linear actuator, which is selectively extendable and retractable in order to selectively clamp the jaw retainers. Extension and retraction of the linear actuator is preferably powered by a pressurized fluid. Most preferably, the linear actuator is a screw shaft coupled at its distal end to a bi-directional pneumatic motor. By securing a screw collar to the pivotable collar and disposing the screw shaft in threaded engagement with a screw collar, rotation of the pneumatic motor causes in a fluid direction the screw shaft to retract relative to the screw collar. To accommodate retraction of the screw shaft, and therefore clamping of the jaw retainers, one embodiment of the pivotable collar includes a central bore that receives the end of the screw shaft after it has advanced through the screw collar. Most preferably, the pivotable collar includes a tubular portion that is axially aligned with the screw collar for axially receiving the screw shaft.

While the powered door is pivotally coupled to the first jaw retainer, the door must be able to selectively engage and clamp the second jaw retainer. Accordingly, the linear actuator carries a latch element that cooperatively engages with a mating latch element formed on the distal end of the second jaw retainer. The latch elements may be any of any known type of latch, but preferably forms a stable connection under strong clamping forces. In a preferred embodiment, the linear actuator carries a convex clam shell clamp face and the second jaw retainer forms a concave clam shell seat, such that the convex clamp face and concave seat are self aligning under the clamping force applied by operation of the linear actuator. Advantageously, the clam shell seat or other latch element of the second jaw retainer may be provided without any moving parts. Rather, the jaw retainers are clamped by the movement of the latch element carried by the linear actuator in the door.

A linkage mechanism is coupled between the powered door and the first jaw retainer to cause the door to close prior to clamping the distal ends of the jaw retainers. The actuator acts upon the linkage to selectively move the powered door into a clamping position during a first phase of actuation and selectively clamps the distal end of the second jaw retainer during a second phase of actuation. In this manner, the linkage takes advantage of the actuator movement without requiring a dedicated actuator for closing the door and inherently coordinates the closing and clamping movements so that the door must close before it can begin to clamp. Most preferably, the actuator is a double-acting actuator that can reversibly act upon the linkage, so that when the actuator moves in the reverse direction the door must unclamp and selectively release the distal end of the second jaw retainer before acting upon the linkage to selectively move the door to a removed or open position.

It should be recognized that the linkage mechanism may be accomplished in numerous configurations, but preferred configurations will be both simple and reliable. A presently preferred configuration uses a combination of simple mechanical linkages to convert linear actuation to controlled closing of the door. The preferred configuration includes a sliding plate cam secured to the linear actuator, a simple link arm pivotally secured to the first jaw retainer, and a bell crank that is pivotally secured to each of the sliding plate cam, the simple link arm and the pivotable collar. In this configuration, the bell crank pivots about a fixed pivot point on the collar. The bell crank also secures a rod or pin that is received within a groove of the sliding plate cam. A third point on the bell crank is pivotally coupled to a second end of the simple link arm. Retraction of the actuator causes the sliding plate cam to retract along the collar with the bell crank pin sliding through the groove. When a dog leg in the groove reaches the pin, continued retraction of the sliding plate cam imparts a transverse (outward) force on the pin. The bell crank pin, in turn, causes the bell crank to pivot about the fixed pivot point on the collar. The bell crank pivot coupled to the simple link arm also moves about the fixed pivot point and imparting a pulling force (tension) on the simple link arm. In order for this pulling force to rotate the door in a closing direction, a line between the two pivot points of the simple link arm (i.e., the simple link arm pivots with the bell crank and the first jaw retainer) must be inwardly offset from the axis of pivot coupling between the collar and the first jaw retainer. Accordingly, the pulling force on the simple link arm place a rotational moment on the collar and the door closes.

The dog leg in the groove of the sliding plate cam is designed in conjunction with the bell crank and the simple link arm so that the door completely closes during retraction of the linear actuator and positions the latch element of the door in alignment with the latch element of the second jaw retainer. After the pin has slid along the dog leg segment of the groove causing the door to close, the pin enters a second segment of the groove that is parallel to the linear movement of the linear actuator. Continued retraction of the linear actuator causes the pin to slide within this second segment of the groove such that the door is held closed, but causes no further closing movement. The linear actuator retracts until the door is latched and the jaw retainers are clamped.

It should be recognized that reversing the direction of the actuator and the movement of the linear actuator causes door and linkage mechanism to go through a reversal of the foregoing process. In particular, the single joint elevator can be made to release a tubular segment by initiating extension of the linear actuator. Extension of the linear actuator causes the clamping force to loosen, the latch elements to unseat and separate, and then the linkage mechanism forces the door to swing open as the pin slides into and through the dog leg segment of the groove to force rotation of the bell crank. With the door opened, an operator can manually swing the jaw retainers apart to disengage the tubular segment.

As used herein, the term "single joint elevator" is intended to distinguish the elevator from a string elevator that is used to support the weight of the entire pipe string. Rather, a "single joint elevator" is used to grip and lift a tubular segment as is necessary to add or remove the tubular segment to or from a tubular string. Furthermore, a pipe or tubular "segment", as that term is used herein, is inclusive of either a single pipe or tubular joint or a stand made up of multiple joints of a pipe or other tubular that will be lifted as a unit. In the context of the present disclosure, a tubular segment does not include a tubular string that extends into the well.

FIG. 1 is a perspective view of a single joint elevator 10 with a first jaw retainer 12 and a second jaw retainer 14 wide open to receive a tubular segment 16. The jaw retainers 12, 14 are secured together by a pivotal coupling 15 and each jaw retainer 12, 14 secures jaws 13 for gripping the tubular segment 16 when the jaw retainers are closed (see FIG. 7). The single joint elevator 10 also includes a powered door 18 that is secured to a distal end of the first jaw retainer 12 by a pivotal coupling 20. The powered door 18 includes a pivotable collar 22, a linear actuator assembly 24, and a linkage mechanism 26. As shown in FIG. 1, the powered door 18 is held in a fully open position.

Figure 1A:
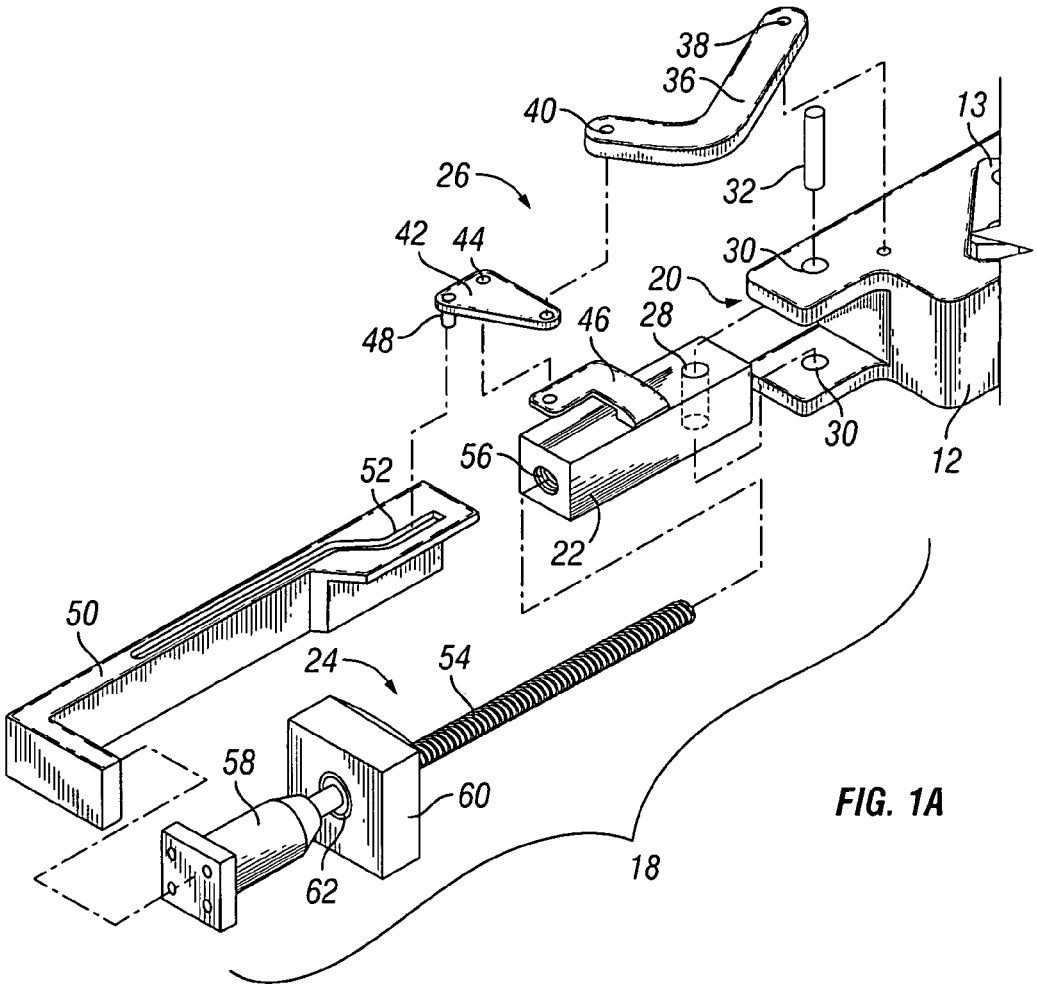
FIG. 1A is an exploded view of the powered door of the single joint elevator of FIG. 1 showing each of the pivot connections between the components.

FIG. 1A is an exploded view of the door 18 showing each of the pivot connections between the components. The pivotal coupling 20 between the collar 22 and the first jaw retainer 12 includes a retainer pin hole 28 in the collar that is alignable with holes 30 in the first jaw retainer 12 to receive a retainer pin 32.

The linkage mechanism 26 includes a number of pivotal connections that may be established with pins and nuts, rivets or other known fasteners. However, the exact nature of these pivotal connections will be omitted for simplicity. The linkage mechanism 26 includes a link arm 36 having a pivotal coupling 38 at a proximal end for coupling with the first jaw retainer 12 and a pivotal coupling 40 at a distal end for coupling with a bell crank 42. The bell crank 42 has a fixed pivot coupling 44 for coupling with an arm 46 secured to the collar 22. A slide pin 48 is secured to the bell crank 42 for slidable engagement within a groove 52 formed in a sliding plate cam 50. Furthermore, the screw shaft 54 of the linear actuator assembly 24 is threadably received within a screw collar 56 that is secured to the pivotable collar 22.

The linear actuator assembly 24 includes the sliding plate cam 50 secured to the housing of motor 58 and to the clam shell latch element 60. The motor 58 rotates the screw shaft 54 through a support bearing 62 within the latch element 60. Although the screw shall 54 rotates according to the rotation imparted by the motor 58, the entire linear actuator assembly 24 moves as a unit.

Figure 1B:
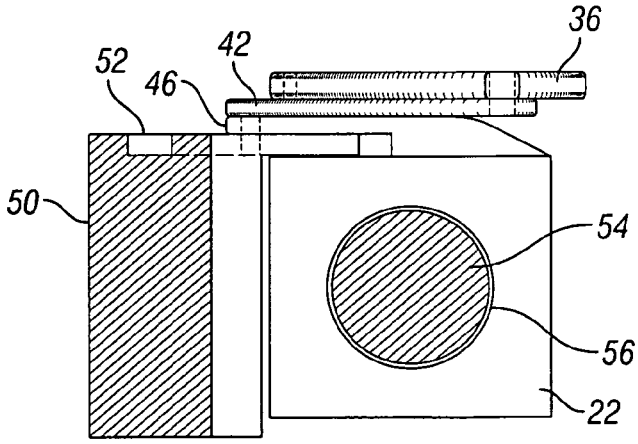
FIG. 1B is a cross sectional view of the rotating screw shaft and sliding plate cam.

FIG. 1B is a cross-sectional view of the rotating screw shaft 54 and sliding plate cam 50. The sliding plate cam 50 preferably has a profile that will slide against the outside surface of the collar 22, such as an arcuate profile facing a cylindrical surface of the collar 22. A portion of the sliding plate cam 50 extends under the arm 46 of the collar 22 and may serve to secure collar 22 against rotation with the screw shaft 54 of the linear actuator assembly 24. The bell crank 42 and the simple link arm 36 are also shown for completeness.

Figure 2:
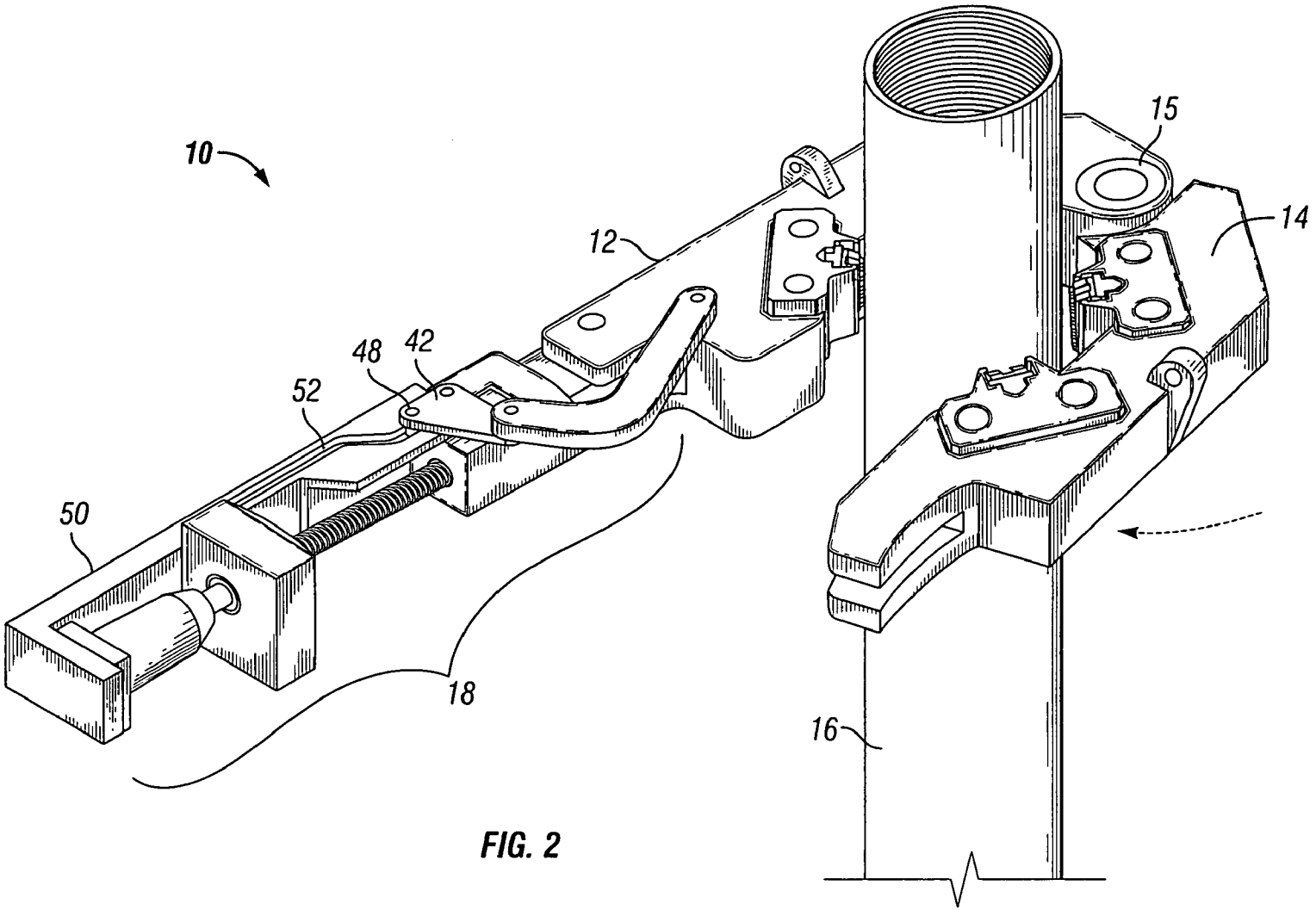
FIG. 2 is a perspective view of the single joint elevator of FIG. 1 with the jaw retainers closed around the tubular segment.

FIG. 2 is a perspective view of the single joint elevator 10 with the jaw retainers 12, 14 closed around the tubular segment 16. The jaw retainers 12, 14 may be manually positioned adjacent the tubular segment and manually closed by pivoting the jaw retainers 12, 14 about the pivot 15. As shown, the jaw retainers have been manually closed about the tubular segment, but the door 18 remains in the fully open or removed position. Furthermore, the slide pin 48 extending from bell crank 42 is positioned near the proximal end of the groove 52 of the sliding plate cam 50.

Figure 3:
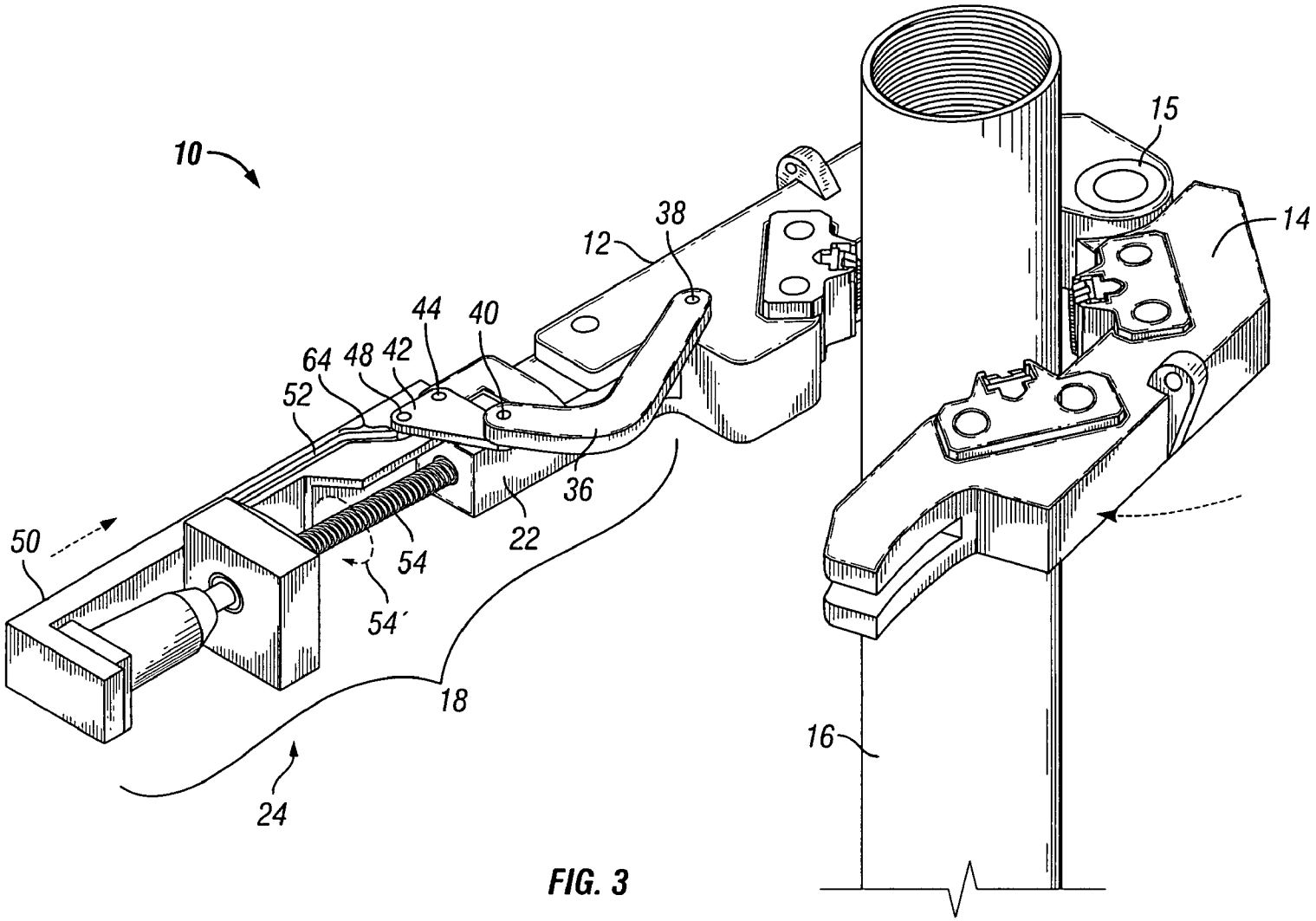
FIG. 3 is a perspective view of the single joint elevator of FIG. 1 with the linear actuator assembly slightly retracted by rotating the screw shad and the door slightly shortened without the door not yet beginning to swing to a close a position.

FIG. 3 is a perspective view of the single joint elevator 10 with the linear actuator assembly 24 slightly retracted by rotating the screw shaft 54 in the direction indicated by arrow 54' and the powered door 18 slightly shortened without the powered door yet beginning to close. As shown, the slide pin 48 extending from bell crank 42 has slid within the groove 52 in the sliding plate cam 50 to a position where the slide pin 48 is approaching the dog leg portion 64 of the groove 52.

Figure 4:
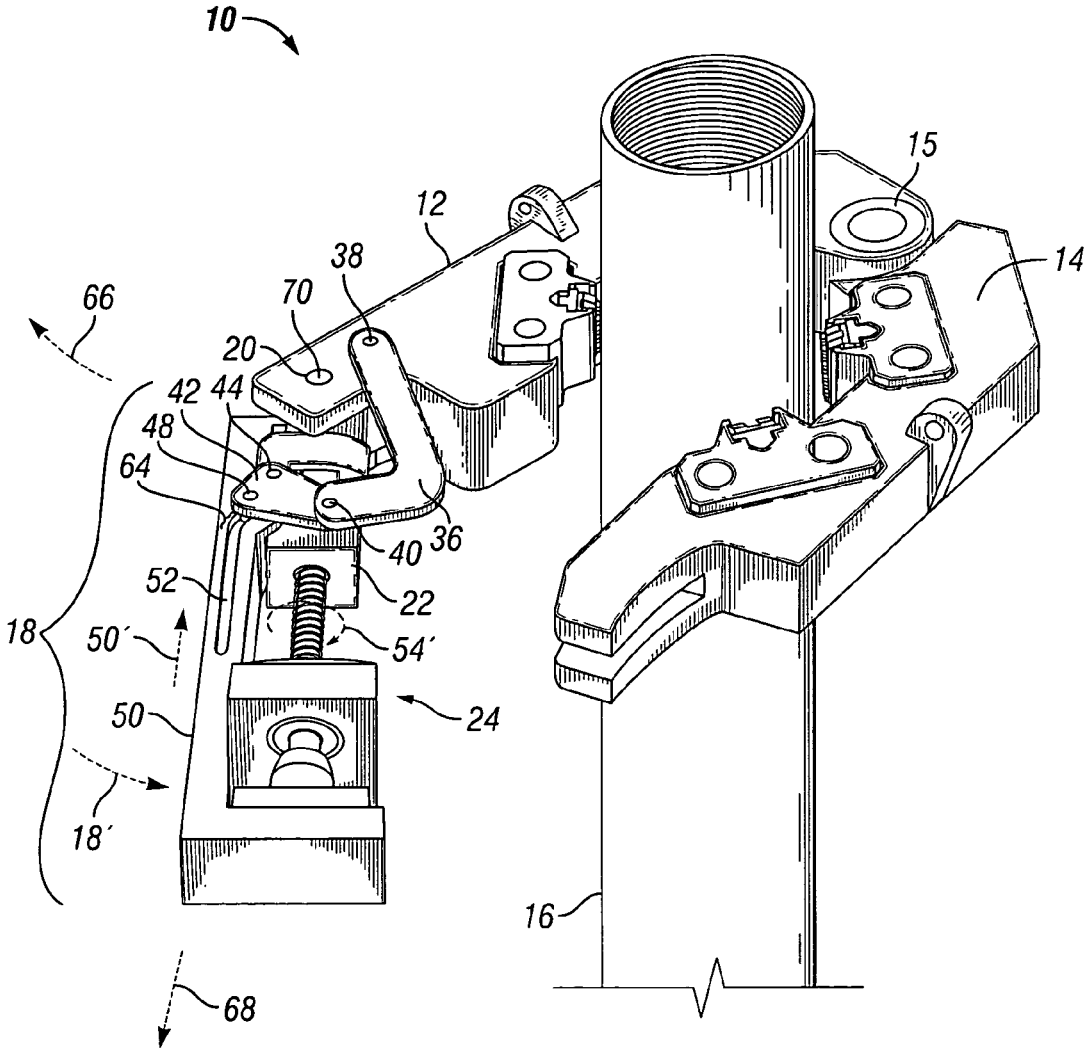
FIG. 4 is a perspective view of the single joint elevator with the linear actuator assembly retracted further from the position of FIG. 3, such that the pin of the bell crank slides into the dog leg segment of the groove.

FIG. 4 is a perspective view of the single joint elevator 10 with the linear actuator assembly 24 retracted further such that the slide pin 48 of the bell crank 42 slides into the dog leg segment 64 of the groove 52. The dog leg segment 64 serves as a "cam" to push the slide pin 48 in the direction of arrow 66. Since the slide pin 48 is part of the bell crank 42 secured to the fixed pivot 44, the force imparted to the slide pin 48 in the direction of arrow 66 imparts a moment on the bell crank 42 about the fixed pivot 44, and the bell crank 42 will impart a force to the pivot 40 in the direction of arrow 68. In turn, the link arm 36 is placed in tension and pulls on the first jaw retainer 12 at the pivot coupling 38. As a result, the powered door 18 is caused to rotate about the axis 70 of the pivot coupling 20 in the direction of arrow 18', and the powered door 18 begins to swing to close.

As rotation of the screw shaft 54 continues in the direction of arrow 54', sliding cam plate 50 will continue to move in the direction of arrow 50', and the camming action of the grooves 52 of the sliding cam plate 50 of the linear actuator assembly 24 on the slide pin 48 will continue until the slide pin 48 leaves the dog leg segment 64 of the groove 52 and enters the linear position of the groove 52.

Figure 5:
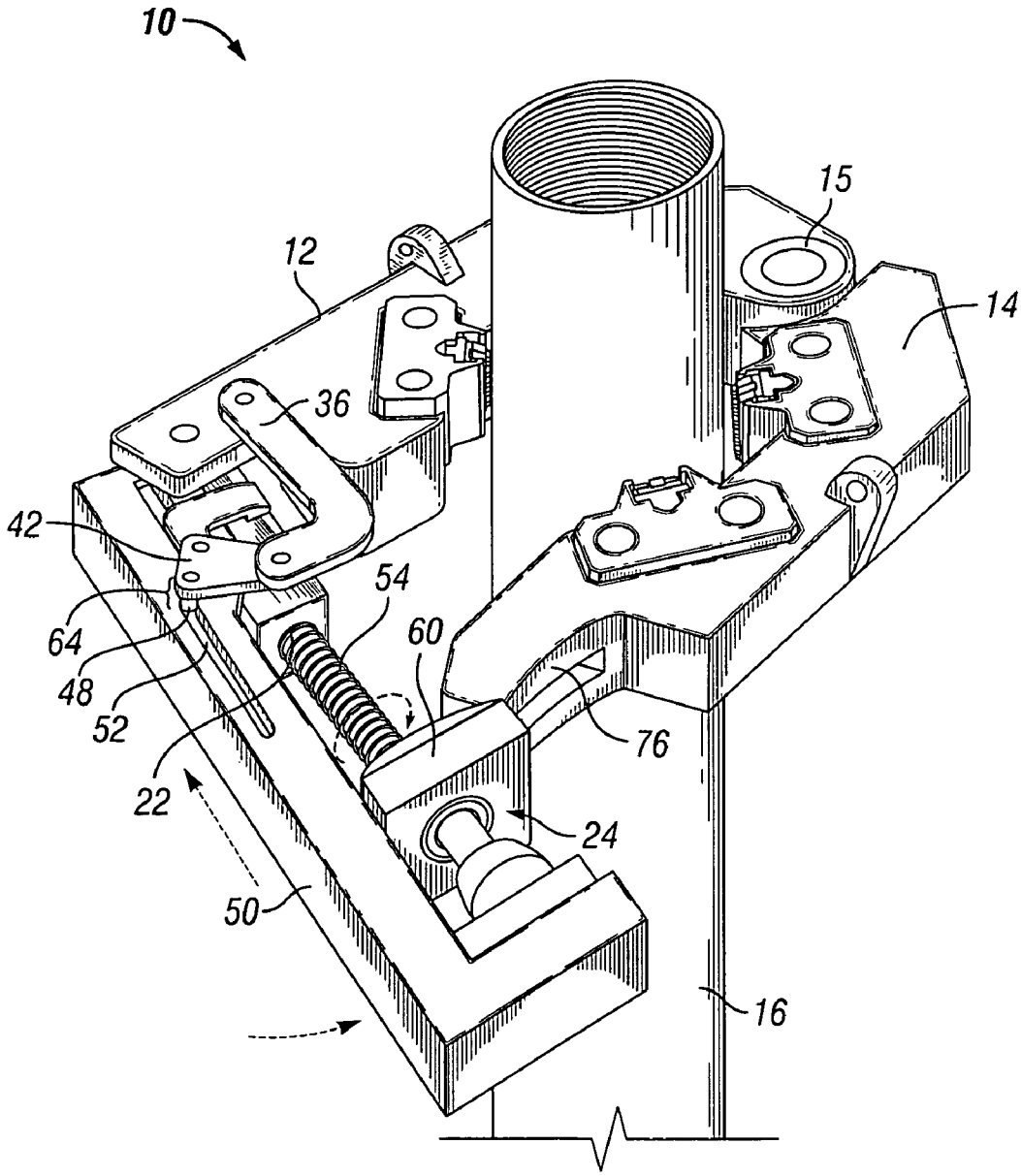
FIG. 5 is a perspective view of the single joint elevator with the linear actuator assembly retracted further such that the pin of the bell crank approaches the end of the dog leg segment of the groove.

FIG. 5 is a perspective view of the single joint elevator 10 with the linear actuator assembly 24 retracted further such that the slide pin 48 of the bell crank 42 approaches the end of the dog-leg segment 64 of groove 52.

Figure 6:
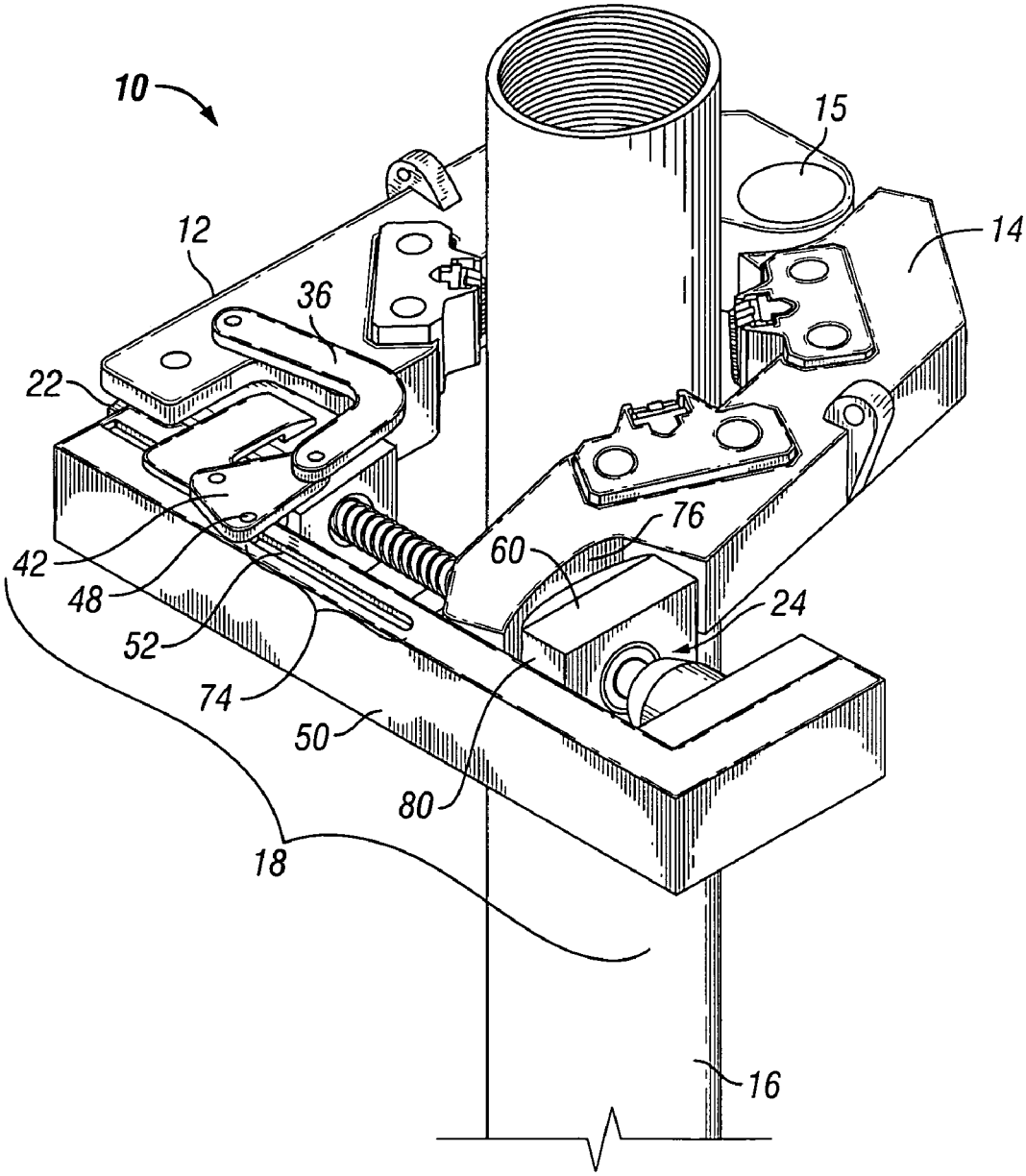
FIG. 6 is a perspective view of the single joint elevator with the door fully closed.

FIG. 6 is a perspective view of the single joint elevator 10 with the powered door 18 fully closed. Since the slide pin 48 has passed completely through the dog-leg segment 64 (hidden from view in FIG. 6—see FIG. 3), there are no more rotational forces placed upon the powered door 18. Rather, the slide pin 48 has entered the straight segment 74 of the groove 52 which holds the powered door 18 in the closed position, as shown. Continued retraction of the linear actuator assembly 24 will move the clam shell clamp element 60 toward the clam shell seat 76 formed on the distal end of the second jaw retainer 14. Referring briefly back to FIG. 5, the clam shell seat 76 preferably includes a slot 78 for receiving the screw shall 54 to facilitate alignment of the clam shell clamp element 60 with the clam shell seat 76 when the door is fully closed.

Figure 7:
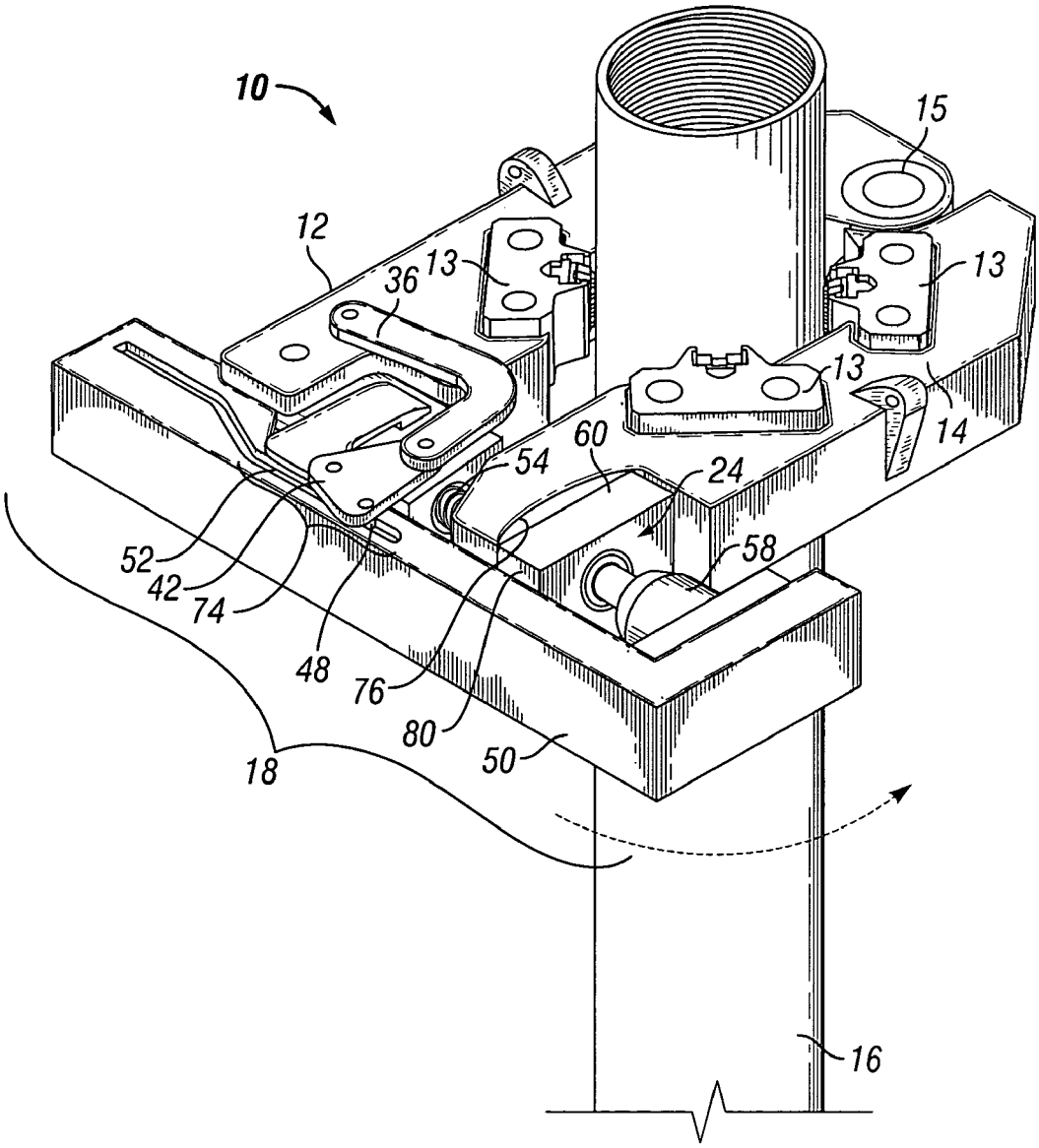
FIG. 7 is a perspective view of the single joint elevator with the linear actuator further retracted such that the clam shell clamp element has engaged the clam shell seat.

FIG. 7 is a perspective view of the single joint elevator 10 with the linear actuator 24 further retracted such that the clam shell clamp element 60 has engaged the clam shell seat 76. Having a clam shell seat 76 that engages the clam shell clamp element 60 both above and below the screw shaft 54 allows for stable engagement there between and prevents the clamping force from causing torque throughout the elevator. In fact, the clam shell clamp element 60 is shown in a preferred configuration with a convex face 80 that mates with the concave surfaces of the clam shell seat 76. Accordingly, the clam shell clamp element 60 and the clam shell seat 76 are self-centering, both vertically and horizontally.

The motor 58 may continue to turn the screw shah 54 until the jaw retainers are clamped so tightly by the powered door 18 that the motor will not turn any further. During this further clamping, the slide pin 48 of the bell crank 42 continues to move down the straight segment 74 of the groove 52, although there should be little or no force being applied against the slide pin since the door position is secured. Although a pressurized fluid, such as air, may be continually applied to the motor while the door is clamping the jaw retainers, a suitable screw-type linear actuator may be sufficiently self-locking that the pressurized fluid may be turned off without any loss of clamping forces. With the jaw retainers 12, 14 clamped in this manner, the four jaws 13 forcibly grip and secure the tubular segment 16. This condition of the single joint elevator 10 is maintained during the handling of the tubular segment.

When it is desired for the single joint elevator 10 to release the grip on the tubular segment 16, the motor 58 is reversed to cause extension of the linear actuator assembly 24. As the extension proceeds, the single joint elevator 10 goes through a reversal of the foregoing process of FIGS. 2 through 7. More specifically, extension of the linear actuator causes the clamping force to loosen, the latch elements to unseat and separate, and then the linkage mechanism forces the door 18 to swing open as the slide pin slides into and through the dog leg segment 64 of the groove to force rotation of the bell crank 42. With the door opened, an operator can manually swing the jaw retainers apart to disengage the tubular segment.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. A single joint elevator for gripping a tubular segment to be hoisted by a hoisting member, comprising:

a first jaw retainer having a proximal end pivotally coupled to a proximal end of a second jaw retainer for movement of the retainers between an opening position for receiving a tubular segment and a closed position for engaging the tubular segment, each jaw retainer securing at least one jaw between the proximal end and a distal end, and each jaw having at least one gripping surface for engaging the tubular segment;

a powered door pivotally coupled to the distal end of the first jaw retainer for selectively securing to the distal end of the second jaw retainer, the powered door including a pivotable collar, a linear actuator assembly supported by the pivotable collar, and a linkage mechanism for selectively closing the door and clamping the distal end of the second jaw retainer to the distal end of the first jaw retainer, wherein the linear actuator assembly selectively clamps the first and second jaw retainers with sufficient force for the jaws to grip and support the tubular segment for lifting;

wherein the linear actuator assembly includes a fluid powered motor, a drive screw rotatably coupled to the fluid powered motor, and a sliding plate cam that moves linearly with the linear actuator assembly to act upon the linkage mechanism;

wherein the drive screw threadably engages a stationary screw collar secured to the pivotable collar; and wherein the linear actuator acts upon the linkage mechanism to selectively move the powered door into a closed position during a first phase of actuation and selectively clamps the distal end of the second jaw retainer during a second phase of actuation.

2. The single joist elevator of claim 1, wherein the actuator is a double-acting actuator.

3. The single joint elevator of claim 1, wherein the double-acting actuator may further selectively release the distal end of the second jaw retainer and act upon the linkage to selectively move the powered door to a removed position.

4. The single joint elevator of claim 1, wherein the linkage mechanism includes a bell crank that is rotated by linear movement of the sliding plate cam, and wherein rotation of the bell crank pulls the powered door into the closed position.

5. The single joint elevator of claim 1, wherein the powered door includes a clam shell clamp member that moves with the linear actuator assembly, and wherein the second jaw retainer includes a clam shell seat for receiving the clam shell clamp member.

6. The single joint elevator of claim 5, wherein the clam shell set self-centers the clam shell clamp member during clamping of the jaw retainers.

7. The single joint elevator of claim 5, wherein the clam shell seat includes a slot for receiving a portion of the linear actuator assembly.

8. The single joint elevator of claim 5, wherein the clam shell set self-centers the clam shell clamp member during clamping of the jaw retainers.

9. The single joint elevator of claim 5, wherein the clam shell seat includes a slot for receiving a portion of the linear actuator assembly.

10. The single joint elevator of claim 1, wherein there are at least three jaws.

11. The single joint elevator of claim 1, wherein each jaw retainer secures two jaws.

12. The single joint elevator of claim 1, wherein each jaw has a tapered back to self energize the grip of the elevator using the weight of the tubular segment.

13. A single joint elevator for gripping a tubular segment to be hoisted by a hoisting member, comprising:

a first jaw retainer having a proximal end pivotally coupled to a proximal end of a second jaw retainer for movement of the retainers between an opening position for receiving a tubular segment and a closed position for engaging the tubular segment, each jaw retainer securing at least one jaw between the proximal end and a distal end, and each jaw having at least one gripping surface for engaging the tubular segment;

a powered door pivotally coupled to the distal end of the first jaw retainer for selectively securing to the distal end of the second jaw retainer, the powered door including a pivotable collar, a linear actuator assembly supported by the pivotable collar, and a linkage mechanism for selectively closing the door and clamping the distal end of the second jaw retainer to the distal end of the first jaw retainer, wherein the linear actuator assembly selectively clamps the first and second jaw retainers with sufficient force for the jaws to grip and support the tubular segment for lifting;

wherein the linear actuator assembly includes a fluid powered motor and a drive screw rotatably coupled to the fluid powered motor;

wherein the drive screw threadably engages a stationary screw collar secured to the pivotable collar;

wherein the linear actuator acts upon the linkage mechanism to selectively move the powered door into a closed position during a first phase of actuation and selectively clamps the distal end of the second jaw retainer during a second phase of actuation;

wherein the powered door includes a clam shell clamp member that moves with the linear actuator assembly, and wherein the second jaw retainer includes a clam shell seat for receiving the clam shell clamp member.

* * * * *